US006652358B1

(12) United States Patent
Ikeda et al.

(10) Patent No.: US 6,652,358 B1
(45) Date of Patent: Nov. 25, 2003

(54) DOUBLE-SIDED SIMULTANEOUS GRINDING METHOD, DOUBLE-SIDED SIMULTANEOUS GRINDING MACHINE, DOUBLE-SIDED SIMULTANEOUS LAPPING METHOD, AND DOUBLE-SIDED SIMULTANEOUS LAPPING MACHINE

(75) Inventors: Shunichi Ikeda, Nishishirakawa-gun (JP); Sadayuki Okuni, Nishishirakawa-gun (JP); Tadahiro Kato, Nishishirakawa-gun (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 09/720,688

(22) PCT Filed: Apr. 27, 2000

(86) PCT No.: PCT/JP00/02700

§ 371 (c)(1),
(2), (4) Date: Dec. 29, 2000

(87) PCT Pub. No.: WO00/67950

PCT Pub. Date: Nov. 16, 2000

(30) Foreign Application Priority Data

May 7, 1999 (JP) ..... 11-126603
Dec. 13, 1999 (JP) ..... 11-352991

(51) Int. Cl.[7] ..... B24B 49/00

(52) U.S. Cl. ..... 451/8; 451/9; 451/262; 451/264; 451/265

(58) Field of Search ..... 451/8, 9, 262, 451/264, 265, 269

(56) References Cited

U.S. PATENT DOCUMENTS 5,989,108 A 11/1999 Ikeda et al. ..... 451/268

FOREIGN PATENT DOCUMENTS

| | | |
|---|---|---|
| JP | 78236/1983 | 10/1983 |
| JP | A 9-262747 | 10/1997 |
| JP | A 9-272049 | 10/1997 |
| JP | A-10000543 | 1/1998 |
| JP | A 10-217074 | 8/1998 |
| JP | A-10217079 | 8/1998 |
| JP | A 11-77497 | 3/1999 |
| JP | A-11090801 | 4/1999 |

*Primary Examiner*—Joseph J. Hail, III
*Assistant Examiner*—Alvin J. Grant
(74) *Attorney, Agent, or Firm*—Oliff & Berridge, PLC

(57) ABSTRACT

In a double side simultaneous grinding machine, in which a plate-like workpiece is held and ground simultaneously on both a front surface and a back surface using a pair of grinding stones provided oppositely at both sides of the workpiece, a relative position between at least one of the center of thickness of the plate-like workpiece and the center of the holding means for holding the workpiece, and the center between stone surfaces of the pair of grinding stones is controlled during grinding. In a double side simultaneous grinding method, the generation of warpage of the plate-like workpiece is suppressed and degradation of warpage is prevented. Thereby, the plate-like workpiece can be processed to have high flatness on both sides. Further, the plate-like workpiece can be ground while a degree of warpage is controlled so that the workpiece is processed to have a warpage of a desired degree.

22 Claims, 5 Drawing Sheets

(a)

(b)

(c)

DOUBLE-SIDED SIMULTANEOUS GRINDING METHOD, DOUBLE-SIDED SIMULTANEOUS GRINDING MACHINE, DOUBLE-SIDED SIMULTANEOUS LAPPING METHOD, AND DOUBLE-SIDED SIMULTANEOUS LAPPING MACHINE

BACKGROUND OF THE INVENTION

1. Technical Field

The present invention relates to a double sided simultaneous grinding method for plate-like workpieces such as a semiconductor wafer or a quartz substrate for an exposure original, a double side simultaneous grinding machine, a double side simultaneous lapping method, and a double side simultaneous lapping machine.

2. Background Art

Surface grinding has been used conventionally in precision processing of plate-like workpieces such as semiconductor wafers or quartz substrates. Surface grinding has come to be used instead of lapping, or the like, because the grinding rate is high, a wafer having high flatness is easily obtained, and so forth.

When a single side surface grinding machine is used in the grinding step, a problem exists that waviness generated in the previous step, i.e., a slicing step, cannot be removed because one side of a wafer is held by a vacuum suction while the other side is ground. In order to solve the problem, a double side simultaneous grinding machine (also referred to as "double head grinding machine") has been developed as a technique for simultaneous grinding both sides of a wafer.

Regarding double head grinding methods for simultaneously grinding the surfaces of a wafer, various methods exist. For example, in a creepfeed grinding method, a wafer is passed between a pair of cylindrical grinding stones and thereby ground. In an infeed grinding method, a wafer is ground using a pair of cup-type grinding stones such that the grinding stones pass along the center of the wafer with the grinding stones and the wafer rotating together.

An infeed-type double side simultaneous grinding machine 1*a* used for grinding a semiconductor wafer, illustrated in FIG. 6, comprises a pair of cup-type grinding stones 20, 21 that rotate in the same direction, two pairs of plate-like workpiece press rollers 4 for supporting a plate-like workpiece W on each side, four plate-like workpiece guide rollers 5 for supporting a circumference of the plate-like workpiece W, and a pair of plate-like workpiece driving-holding rollers 3 for rotating the plate-like workpiece W in an opposite direction to the direction of the grinding stones and holding the workpiece. The cup type grinding stones 20, 21 consist of a cup-shaped stock 2*a*, a grinding stone portion 2*b* and a grinding stone rotating shaft 2*c*. Grinding stone segments (not shown) are connected to a grinding surface of the grinding stone portion 2*b*. The plate-like workpiece W and the cup type grinding stones 20, 21 are rotated at a predetermined rotational speed. Grinding fluid is generally fed from a central hole (not shown) of the grinding stone rotating shaft 2*c*, or poured onto outer periphery or an inside portion of the grinding stone.

Along with the development of the double side simultaneous grinding machine, a double side simultaneous lapping machine for single wafer processing has been developed in place of conventional batch processing lapping machines which have low accuracy and low productivity. The lapping process using this single wafer processing lapping machine has the advantages of the surface grinding, such as high efficiency in processing and automation with high accuracy. Further, this lapping process has the advantages of conventional lapping, obtaining the same surface condition and an equal back surface condition.

A double side simultaneous lapping machine of the infeed-type 1*a* is shown in FIG. 6. The pair of cup-type grinding stones 20, 21 is replaced with flat lapping turn tables. For driving a plate-like workpiece, the lapping machine adopts the same mechanism as that of the double side simultaneous grinding machine. However, there is a wide variance in terms of feeding the grinding stones or the turn tables. Feeding the grinding stones in the grinding machine is accomplished by controlling a servomotor or the like, which is a so-called "infeed". On the other hand, since the turn tables of the lapping machine are basically controlled at a constant pressure, the turn tables are always supported by a pressurizing mechanism such as air cylinder.

As to a difference in actual processing of the plate-like workpiece, the material operating in the grinding machine is bonded abrasives of the cup type grinding stones, while the lapping machine uses a lapping fluid (slurry) containing alumina abrasives and the like which are loose abrasives.

In recent years, the above-mentioned infeed-type grinding method has been used generally because of the advantage of easily obtaining high flatness as compared to the creep-feed type. However, in the infeed-type method, a problem exists that warpage (hereinafter also referred to as "warp") is apt to be generated in the ground workpiece due to an unbalance of cutting loads on each side, and so forth.

A technique is known wherein coolant is injected from static pressure pads such that a plate-like workpiece is stably supported (for example, see Japanese Patent Laid-open Publication (Kokai) No. 9-262747). However, it has been found that this technique necessarily cannot sufficiently suppress the generation of warpage. Moreover, it has been found that the warpage of the wafer after double head grinding is apt to be worse (degrade) than the warpage before the grinding. Since it is difficult to remove warpage in processing steps subsequent to the grinding step, such problems should be solved in the grinding step to achieve a higher flatness.

SUMMARY OF THE INVENTION

The present invention has been accomplished in view of the above-mentioned problems, and its major object is to provide a double side simultaneous grinding method using a double side simultaneous grinding machine wherein the generation of warpage of a plate-like workpiece is suppressed and or the degradation of warpage generated in a previous step is prevented. Thereby the plate-like workpiece can be processed to have high flatness on both sides. An object of the present invention is also to provide a double side simultaneous grinding machine having such characteristics.

Another object is to provide a double side simultaneous grinding method, wherein a plate-like workpiece is ground while a degree of warpage is controlled. Thereby, the workpiece can be processed to have a desired warpage. Another object is to provide a double side simultaneous grinding machine having such a characteristic.

A double side simultaneous lapping machine having a similar structure as the double side simultaneous grinding machine has similar problems as those of the double side simultaneous grinding machine described above. Another object of the present invention is to provide a double side simultaneous lapping method, wherein the generation of warpage of a workpiece is suppressed and/or the degradation of warpage generated in a previous step is prevented. Thereby, the workpiece can be lapped to have high flatness on both sides. Another object is to provide a lapping method wherein the workpiece is lapped while a degree of warpage is controlled. Thereby, the workpiece can be processed to have a desired warpage. Another object is to provide a double side simultaneous lapping machine having such characteristics.

In order to solve the aforementioned problems, the present invention provides a method for simultaneously grinding both a front surface and a back surface of a plate-like workpiece that is held and simultaneously ground on both sides using a pair of grinding stones opposed at both sides of the workpiece, wherein a relative position of at least one of a center between stone surfaces of the pair of grinding stones and at least one of a center of thickness of the plate-like workpiece and a center of the holding means for holding the workpiece is controlled while performing the grinding.

The center of thickness of a plate-like workpiece is a reference for defining a position of the plate-like workpiece and may be, for example, a line or plane passing points (center) of one half of the thickness at two or more points on a surface of the plate-like workpiece.

The center of holding means for holding the plate-like workpiece, for example when the plate-like workpiece is supported on both a front surface and a back surface of the workpiece, is a virtual plane or line passing points one half of the distance between the pair of holding means provided at each side of the workpiece, namely a plane approximately parallel to the plane passing the center of thickness of the plate-like workpiece.

If the plate-like workpiece has high flatness (parallelism), the center of the holding means for holding the plate-like workpiece coincides with the center of thickness of the plate-like workpiece. That is, the center of the holding means for holding the plate-like workpiece indirectly reflects the center of thickness of the plate-like workpiece, i.e., the position of the plate-like workpiece.

The center between the stone surfaces of a pair of grinding stones is a reference for defining a position of the grinding stones. In particular, this center may be a virtual line or plane passing points one half of the distance between the pair of grinding stones. More specifically, this center may be a virtual line or plane passing mid-points at two or more points on opposite grinding surfaces, namely a plane or line approximately parallel to the center of thickness of the plate-like workpiece.

That is, in the present invention, the grinding is performed while a relative position is controlled between an arbitrary reference plane or reference line for defining the position of the plate-like workpiece, and an arbitrary reference plane or reference line for defining the position of each grinding stone. More specifically, the position of each grinding surface is always controlled relative to the workpiece. In particular, when the relative position is controlled such that each reference plane of the plate-like workpiece and the grinding surfaces are parallel to each other, control of warpage can be attained with high accuracy.

If, in the method for simultaneously grinding both sides of a plate-like workpiece, the grinding is performed while the relative position between at least one of the center of thickness of the plate-like workpiece and the center of the holding means for holding the workpiece, and the center between stone surfaces of the pair of grinding stones is controlled as mentioned above, the generation of warpage in the grinding step can be prevented and degradation of warpage generated in the previous step can be suppressed, so that whole surfaces of both sides of the plate-like workpiece can be processed to have high flatness. Accordingly, in the grinding step, increased yield and an improvement in productivity can be attained. Therefore, cost can be improved. Further, warpage having an arbitrary degree can be formed intentionally and direction of warpage can be controlled. Thus, the method can be applied to provide characteristics demanded for particular uses of the plate-like workpiece.

In such a case, the grinding can be performed while at least one of the center of thickness of the plate like workpiece and the center of the holding means for holding the plate-like workpiece is always consistent with the center between the stone surfaces of the pair of grinding stones.

If the grinding is performed while at least one of the center of thickness of the plate-like workpiece and the center of the holding means for holding the workpiece is always consistent with the center between the surfaces of the pair of grinding stones as mentioned above, warpage is hardly formed and degradation of warpage generated in the previous step can be suppressed, so that whole surfaces of both sides of the plate-like workpiece can be processed to have high flatness. Accordingly, yield and productivity in the grinding step can be increased, and cost can be improved.

In such a case, the grinding is desirably performed while the difference between at least one of the center of thickness of the plate-like workpiece and the center of the holding means for holding the workpiece, and the center between the surfaces of the pair of grinding stones is controlled so as to be 3 $\mu$m or less.

If the grinding is performed while the difference between both centers is controlled so as to be 3 $\mu$m or less as mentioned above, the generation of warpage is certainly prevented, so that whole surfaces of both sides of the plate-like workpiece can be processed to have even higher flatness.

Further, in such a case, the grinding can be performed while the difference between at least one of the center of thickness of the plate-like workpiece and the center of the holding means for holding the work piece, and the center between the surfaces of the pair of grinding stones is controlled so as to be a desired value.

If the grinding is performed while the difference between both centers is controlled so as to be a desired value as mentioned above, a warpage having an arbitrary degree can be formedand/or the direction of warpage can be controlled. Thus, the method can meet specific requirements for the characteristics of the plate-like workpiece.

The present invention also provides a double side simultaneous grinding machine having at least a holding means for holding a plate-like workpiece, a grinding means for simultaneously grinding the both a front surface and a back surface of the workpiece using a pair of grinding stones provided oppositely at both sides of the workpiece, and a controlling means for controlling a relative position of a center between stone surfaces of the pair of grinding stones and at least one of a center of thickness of the plate-like workpiece and the center of the holding means for holding the workpiece.

The controlling means for controlling the relative position between at least one of the center of thickness of the plate-like workpiece and the center of the holding means for holding the workpiece, and the center between stone surfaces of the pair of grinding stones is, for example, a means for controlling a position of the line or plane passing points one half of the thickness at two or more points on a surface of the plate-like workpiece and/or the virtual line or plane, parallel to the grinding surfaces, passing points one half of the distance between the pair of holding means when the plate-like workpiece is supported on both the front surface and the back surface of the workpiece, relative to the reference for defining a position of the grinding stones, e.g., the virtual line or plane passing points one half of the distance between the pair of grinding stones, similar to the aforementioned reference for defining the position of the plate-like workpiece.

If the double side simultaneous grinding machine is provided with the controlling means for controlling the relative position as mentioned above, the grinding can be performed while the relative position of both centers is controlled. Thereby, the generation of warpage in the grinding step can be prevented. Therefore, the machine can process the plate-like workpiece to have high flatness for whole surfaces on both sides. Accordingly, if the plate-like workpiece is ground by using this double side simultaneous grinding machine, yield and productivity in the grinding step can be increased. Therefore, cost can be improved. Further, a warpage having an arbitrary degree can be formed and the direction of warpage can be controlled. Thus, the machine can meet requirements for individual characteristics of plate-like workpieces.

In such a case, the double side simultaneous grinding machine is provided with a means for controlling the relative position which comprises a means for detecting a position of the holding means for holding the plate-like workpiece, a means for detecting positions of each grinding stone surface, a computer for processing the detected positions, and a means for changing at least one of the position of the holding means and the positions of the grinding stones based on the detected positions processed by the computer. An actuator, such as a motor, an air cylinder or a hydraulic cylinder, may based as the means for changing the position of the holding means and/or the positions of the grinding stones.

If the machine has such a structure, the position of the holding means for holding the plate-like workpiece and the position of each grinding stone surface are always detected. The detection results are processed by a computer and the position of the holding means and/or the grinding stones is changed based on the data processed by the computer, so that the workpiece is held in a desired position to be ground. Therefore, the machine can process the plate-like workpiece to have high flatness for whole surfaces on both sides. Accordingly, if the plate-like workpiece is ground using this double side simultaneous grinding machine, yield and productivity in the grinding step can be increased, and therefore the cost can be improved.

In such a case, it is desirable that the means for controlling the relative position controls the relative position so as to be 3 $\mu$m or less, or to be constant at a predetermined value.

If the grinding is performed using the double side simultaneous grinding machine having the controlling means capable of such control with high accuracy, the machine can process the plate-like workpiece to certainly have high flatness for whole surfaces on both sides.

The present invention also provides a double side simultaneous lapping method in which a plate-like workpiece is held and lapped simultaneously for the both a front surface and a back surface using a pair of lapping turn tables provided oppositely at both sides of the workpiece, wherein a relative position between the center between turn table surfaces of the pair of lapping turn tables and at least one of the center of thickness of the plate-like workpiece and the center of the holding means for holding the workpiece is controlled to perform the lapping.

The definition of the terminology such as the center of thickness of the plate-like workpiece, the center of the holding means for holding the workpiece, the center between turn table surfaces of the pair of lapping turn tables is the same as that discussed with respect to the aforementioned double side simultaneous grinding method.

If, in the method for simultaneously lapping both sides of a plate-like workpiece, the lapping is performed while at least one of the relative position between the center of thickness of the plate-like workpiece and the center of the holding means for holding the workpiece, and the center between turn table surfaces of the pair of lapping turn tables is controlled as mentioned above, the generation of warpage in the lapping step can be prevented and the degradation of warpage generated in the previous step can be suppressed, so that whole surfaces of both sides of the plate-like workpiece can be processed to have high flatness. Accordingly, yield and productivity in the lapping step can be increased, and therefore the cost can be improved. Further, a warpage having an arbitrary degree can be formed intentionally and the direction of warpage can also be controlled. Thus, the method can be applied to provide characteristics demanded for particular uses of the plate-like workpiece.

In such a case, the lapping can be performed while at least one of the center of thickness of the plate-like workpiece and the center of the holding means for holding the workpiece is always consistent with the center between the turn table surfaces of the pair of lapping turn tables.

If the lapping is performed while at least one of the center of thickness of the plate-like workpiece and the center of the holding means for holding the workpiece is always consistent with the center between the surfaces of the pair of lapping turn tables, warpage is hardly formed and degradation of warpage generated in the previous step can be suppressed, so that whole surfaces of both sides of the plate-like workpiece can be processed to have high flatness. Accordingly, yield and productivity in the lapping step can be increased, and therefore cost can be improved.

In such a case, the lapping is preferably performed while the difference between at least one of the center of thickness of the plate-like workpiece and the center of the holding means for holding the workpiece, and the center between the turn table surfaces of the pair of lapping turn table is controlled so as to be 3 $\mu$m or less.

If the lapping is performed while the difference between both centers is controlled so as to be 3 $\mu$m or less as mentioned above, the generation of warpage is certainly prevented, so that whole surface of both sides of the plate-like workpiece can be processed to have even higher flatness.

Further, in such a case, the lapping can be performed while the difference between at least one of the center of thickness of the plate-like workpiece and the center of the holding means for holding the workpiece, and the center between the surfaces of the pair of lapping turn tables is controlled so as to be a desired value.

If the lapping is performed while the difference between each center is controlled so as to be a desired value as mentioned above, formation of warpage having an arbitrary degree and control of direction of warpage can be realized.

Thus, the method can meet requirements for specific characteristics of the plate-like workpiece.

The present invention also provides a double side simultaneous lapping machine having at least a holding means for holding a plate-like workpiece, a lapping means for simultaneously lapping the both a front surface and a back surface using a pair of lapping turn tables provided oppositely at both sides of the workpiece, and a controlling means for controlling the relative position between the center between turn table surfaces of the pair of lapping turn tables and at least one of the center of thickness of the plate-like workpiece and the center of the holding means for holding the workpiece.

The means for controlling the relative position between at least one of the center of thickness of the plate-like workpiece and the center of the holding means for holding the workpiece, and the center between turn table surfaces of the pair of lapping turn tables, is similar to the reference for defining the position of the plate-like workpiece and previously described above concerning the double side simultaneous grinding machine.

If the double side simultaneous lapping machine is provided with the controlling means for controlling the relative position between at least one of the center of thickness of the plate-like workpiece and the center of the holding means for holding the workpiece, and the center between turn table surfaces of the pair of lapping turn tables as mentioned above, the lapping can be performed while the relative position of both centers is controlled. Thereby, the generation of warpage in the lapping step can be prevented. Therefore, the machine can process the plate-like workpiece to have high flatness for whole surfaces on both sides. Accordingly, if the plate-like workpiece is lapped using this double side simultaneous lapping machine, yield and productivity in the lapping step can be increased, and therefore cost can be improved. Further, a warpage having an arbitrary degree can be formed and the direction of warpage can be controlled. Thus, the machine can meet requirements for individual characteristics of plate-like workpieces.

In such a case, the double side simultaneous lapping machine is provided with a means for controlling the relative position which comprises a means for detecting a position of the holding means for holding the plate-like workpiece, a means for detecting positions of each lapping turn table surface, a computer for processing the detected positions, and a means for changing the position of at least one of the holding means and the lapping turn tables based on the detected positions processed by the computer.

If the machine has such a structure, the position of the holding means for holding the plate-like workpiece and the positions of each lapping turn table surface are always detected, the detected positions are processed by a computer, at least one of the position of the holding means and the position of the lapping turn tables is changed based on the data processed by the computer, so that the workpiece is held in a desired position to be lapped. Therefore, the machine can process the plate-like workpiece to have high flatness for whole surfaces on both sides. Accordingly, if the plate-like workpiece is lapped using this double side simultaneous lapping machine, yield and productivity in the lapping step can be increased, and therefore cost can be improved.

In such a case, it is desirable that the means for controlling the relative position controls the relative position so as to be 3 $\mu$m or less, or to be constant at a predetermined value.

If lapping is performed using the double side simultaneous lapping machine having the controlling means capable of such control with high accuracy, the machine can process the plate-like workpiece to certainly have high flatness for whole surfaces on both sides.

According to the present invention, in the double side simultaneous grinding using a double side simultaneous grinding machine, the generation of warpage of a plate-like workpiece is suppressed, degradation of warpage which may be generated due to the grinding is prevented, and the plate-like workpiece can be processed to have high flatness on both sides. Additionally, yield and productivity can be increased and therefore cost can be improved.

Moreover, according to the present invention, the grinding can be performed while a degree of warpage is controlled. Thereby, the workpiece can be processed to have warpage of a desired degree.

Further, according to the present invention, in the double side simultaneous lapping using the double side simultaneous lapping machine, the generation of warpage of the plate-like workpiece is suppressed, degradation of warpage generated in the previous step is prevented, and the plate-like workpiece can be processed to have high flatness on both sides. Additionally, yield and productivity can be increased and therefore cost can be improved.

Moreover, according to the present invention, the lapping can be performed while a degree of warpage is controlled. Thereby, the workpiece can be processed to have warpage of a desired degree.

DETAILED DESCRIPTION OF EXEMPLARY EMBODIMENTS

Figure 1:
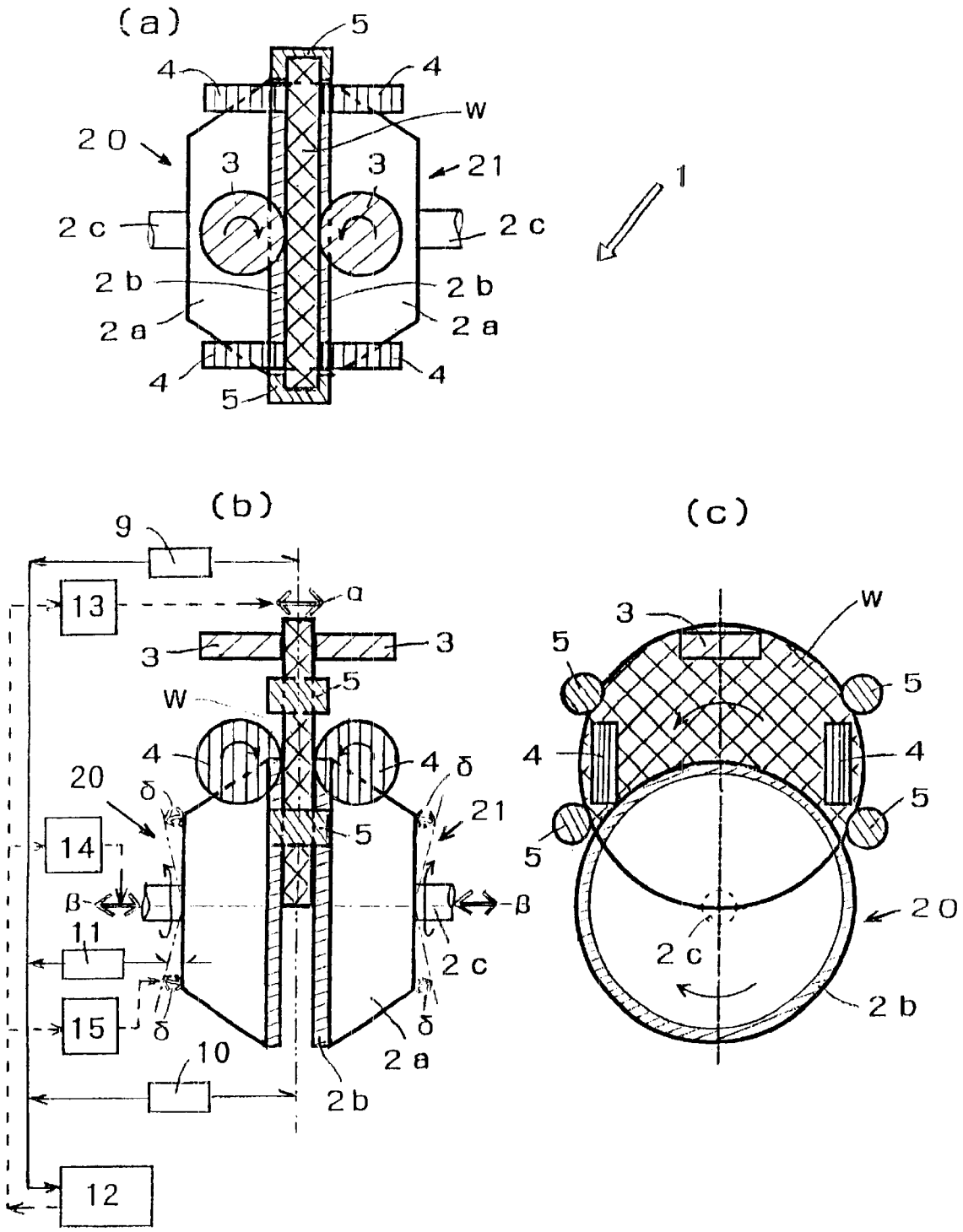
FIG. 1 shows schematic explanatory views of an exemplary double side simultaneous grinding machine according to the present invention: (a) plain view, (b) front view, and (c) side view.

Embodiments of the present invention will be explained hereafter. However, the present invention is not limited to these.

Further, although the following explanation mainly refers to a double side simultaneous grinding method and a double side simultaneous grinding machine, the explanation applies equaly to a double side simultaneous lapping method and a double side simultaneous lapping machine. In examples described hereafter, it is confirmed that lapping has the same problems as those encountered in grinding. Thus, one can obtain similar effects using similar means as those in grinding. Accordingly, unless stated to the contrary, replacement of the word "grinding" with the word "lapping" and replacement of the words "grinding stone" with the words "turn table" in the explanations of the double side simultaneous grinding method and the double side simultaneous grinding machine are appropriate to render explanations of the double side simultaneous lapping method and the double side simultaneous lapping machine.

As described above, when a plate-like workpiece is simultaneously ground on both sides using the conventional infeed-type grinding, problems exist in that warpage is apt to be generated due to an unbalance of the cutting loads on both sides, warpage is inclined to grow worse than before the grinding, and so on. Since it is difficult to remove this warpage in processing steps subsequent to the grinding step, such problems of warpage should be solved in the grinding step to attain higher flatness.

In order to solve such problems, the inventors of the present invention researched the structure of an infeed-type double side simultaneous grinding machine, its processing accuracy, etc., and then experimentally researched and studied the causes of the generation and degradation of warpage. As a result, they found that in double head grinding, the parallelism between stone surfaces of two grinding stones and a plate-like workpiece, the relative position between the pair of grinding stones and the plate-like workpiece, and the grinding force remarkably affect the warpage. Especially, they found that, if the grinding is performed while the center of thickness of the plate-like workpiece (the center of the laminer workpiece holding means) and the center between the surfaces of the pair of grinding stones are always consistent with each other, the plate-like workpiece has hardly any warpage on both sides and can be processed to have high flatness. In addition, they also found that, if the grinding is performed while the above-mentioned difference (discrepancy) between both centers is controlled so as to be a desired value, a plate-like workpiece having a warpage of a desired degree can be produced. Thus, they investigated various grinding conditions, and accomplished the present invention.

First, a double side simultaneous grinding machine and a double side simultaneous lapping machine will be explained with reference to the drawings. Because the double side simultaneous lapping machine is not that different from the double side simultaneous grinding machine in terms of the structure, the double side simultaneous grinding machine will be described below with [] representing the terms and references of the double side simultaneous lapping machine.

Figure 7:
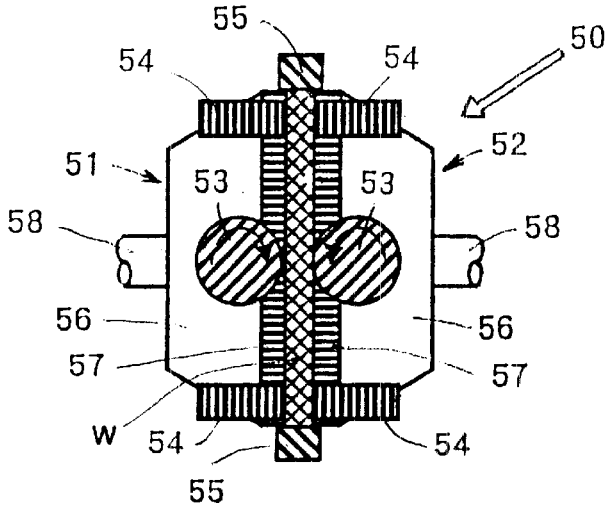
FIG. 7 shows schematic explanatory views of an exemplary double side simultaneous lapping machine according to the present invention: (a) plan view, (b) front view, and (c) side view.
Figure 7:
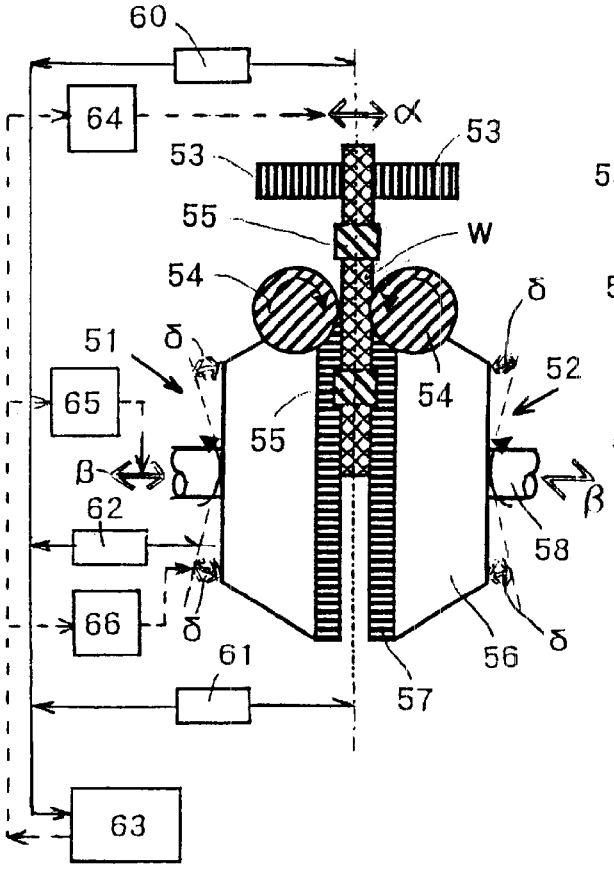
Figure 7:
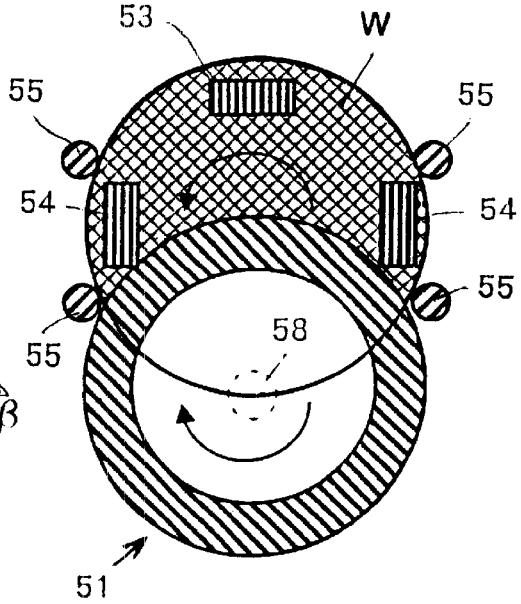

FIG. 1 [FIG. 7] shows schematic explanatory views for explaining a schematic structure of an exemplary double side simultaneous grinding machine [double side simultaneous lapping machine] according to the present invention.

The infeed-type double side simultaneous grinding machine [double side simultaneous lapping machine] of the present invention is an apparatus having a structure for simultaneously grinding [lapping] both sides of a plate-like workpiece, e.g., a semiconductor wafer. As shown in FIG. 1 [FIG. 7], a double side simultaneous grinding machine 1 [double side simultaneous lapping machine 50] comprises a pair of cup-type grinding stones 20, 21 [lapping turn tables 51, 52] rotating in the same direction, two pairs of plate-like workpiece press rollers 4 [54] for supporting a plate-like workpiece W on each side, four plate-like workpiece guide rollers 5 [55] for supporting a circumference of the plate-like workpiece W, and a pair of plate-like workpiece driving-holding rollers 3 [53] for rotating the plate-like workpiece W in the opposite direction to the grinding stones [turn tables] and holding the workpiece. Further, in the double side simultaneous lapping machine, the processing may be performed while each of the lapping turn tables 51, 52 is rotated in an opposite direction to the other. The cup-type grinding stones 20, 21 [lapping turn tables 51, 52] consist of a cup-shaped stock 2*a* [turn table bearer 56], a grinding stone portion 2*b* [turn table surface portion 57] and a grinding stone rotating shaft 2*c* [turn table rotating shaft 58]. Grinding stone segments (not shown) are connected to a grinding surface of the grinding stone portion 2*b*. The plate-like workpiece W and the cup-type grinding stones 20, 21 [lapping turn tables 51, 52] are rotated at a predetermined rotational speed. Grinding fluid [lapping fluid] is generally fed from a central hole (not shown) of the grinding stone rotating shaft 2*c* [turn table rotating shaft 58], or poured onto an outer periphery or an inside portion of the grinding stones [turn tables].

The apparatus for controlling a degree of warpage according to the present invention comprises, for example, a plate-like workpiece holding means (plate-like workpiece) center detector 9 [60] for detecting the center of thickness of the plate-like workpiece and/or the center of the plate-like workpiece holding means which comprises the plate-like workpiece press rollers 4 [54], the plate-like workpiece guide rollers 5 [55] and the plate-like workpiece driving-holding rollers 3 [53] for holding the workpiece, a grinding stone [turn table] surfaces center detector 10 [61] for detecting the center between the grinding stone [turn table] surfaces, a computer 12 [63] for processing the detected positions, and a plate-like workpiece holding means (plate-like workpiece) position controlling means 13 [64] for controlling the position of the plate-like workpiece holding means (plate-like workpiece) and a grinding stone [turn table] surfaces space controlling means 14 [65] for controlling the difference between the grinding stones [turn tables], based on the detected positions processed by the computer 12 [63]. As these controlling means, for example, an actuator, such as a motor, an air cylinder or a hydraulic cylinder, may be used. In the drawings, $\alpha$ and $\beta$ represent a controlled direction and shifting amount to be outputted by each controlling means.

Further, in order to adjust parallelism between the plate-like workpiece W and the grinding [lapping] surfaces of the grinding stone portions 2*b* [turn table surface portions 57] of two grinding stones [turn tables], the apparatus may be provided with a grinding stone [turn table] shaft tilt angle controlling means 15 [66] for adjusting a tilt of grinding stone shaft 2*c* [turn table rotating shaft 58], so that the tilt angle can be adjusted in advance before grinding [lapping] by a stepping motor, or the like. Furthermore, if the apparatus is provided with a grinding stone [turn table] shaft tilt angle detector 11 [62] for detecting the tilt angle of the grinding stone shaft 2*c* [turn table rotating shaft 58] and its detection result is processed by the computer 12 [63] and outputted to the grinding stone [turn table] shaft tilt angle controlling means 15 [66], the control of tilt angle of the grinding stone [turn table] shaft can be automated. Here, 6 represents controlled direction and tilt amount to be outputted by the grinding stone [turn table] shaft tilt angle controlling means.

Next, a grinding [lapping] method of the plate-like workpiece W through use of the above-described double side simultaneous grinding machine 1 [double side simultaneous lapping machine 50] will be explained. The plate-like workpiece W is set on the apparatus so that the workpiece W is supported on each side by two pairs of plate-like workpiece press rollers 4 [54] and at a circumference by four plate-like workpiece guide rollers 5 [55]. Subsequently, the center position of the plate-like workpiece holding means (plate-like workpiece) and the center between the grinding stone [turn table] surfaces are inputted to the computer 12 [63] and set to obtain a warpage of a desired degree. The tilt angles of two grinding stone [turn table] shafts are also adjusted to a predetermined value. Then, the plate-like workpiece W is rotated by the plate-like workpiece driving-holding rollers 3 [53], and the pair of cup=type grinding stones 20, 21 [lapping turn tables 51, 52] with rotation comes close to the workpiece W from each side such that the workpiece is sandwiched between the grinding stones [lapping turn tables]. The grinding stone portions 2*b* [turn table surface portions 57] are brought into contact with the plate-like workpiece W, the plate-like workpiece W and the cup-type grinding stones 20, 21 [lapping turn tables 51, 52] are rotated in opposite directions to each other, and thereby the grinding [lapping] is performed. During grinding [lapping], grinding fluid [lapping fluid] is fed from a central hole (not shown) of the grinding stone rotating shaft 2*c* [turn table rotating shaft 58], or poured onto an outer periphery or an inside portion of the grinding stone [turn table].

Hereinafter, tests for finding a grinding condition for preventing formation of warpage and for suppressing degradation of warpage, and various results will be explained.

The grinding was performed using a double side simultaneous grinding machine having controlling means as shown in FIG. 1.

A semiconductor silicon wafer having a diameter of 200 mm, a thickness of 775 μm, which had been sliced with a wire saw, was used as a plate-like workpiece material.

A basic grinding condition is as follows.

Workpiece rotation number: 7–25 rpm,

Grinding stone: infeed-type cup-type grinding stone having approximately the same diameter as that of the workpiece, which consists of a metal bonded grinding stone #600 or a vitrified bonded grinding stone #2000 (using diamond abrasive grains), Grinding stone rotation number: 2000–3500 rpm, Grinding stone feed rate: 60–300 μm/min, Flow rate of grinding fluid (grinding water): 3–15 L/min, and Grinding stock removal: 60 μm. as total removals of both surfaces.

Test for parallelism between wafer and grinding stones

A wafer having high flatness was experimentally produced under an optimum condition for parallelism between a wafer and grinding stones (parallelism between a reference plane of the center of thickness of the plate-like workpiece and that of the center between stone surfaces of a pair of grinding stones).

By changing the tilt of shaft of the pair of grinding stones (a left grinding stone and a right grinding stone shown in the drawings, and hereinafter referred to as "right-and-left grinding stones"), parallelism between the right-and-left grinding stones and the workpiece was varied. The workpiece was ground. Then its warpage was measured. A metal bonded grinding stone #600 was used as the grinding stone.

The warpage was evaluated and represented as a difference between the highest point and the lowest point on the wafer surface from a designated reference plane of the wafer without sucking fixation. Specifically, the warp was measured through use of an ADE UG9700 (produced by ADE Co.).

A wafer having a little warpage (silicon wafer or glass substrate having high flatness, of which warp is zero) was set on the double side simultaneous grinding machine, and the grinding was performed with the tilt of the right-and-left grinding stone shaft being changed by a stepping motor of the grinding machine (shift amount of tilt of grinding stone shaft $\delta$=−4, −2, 0, 2, 4 (μm)). This shift amount of tilt, $\delta$, is represented as a distance to which a grinding stone portion contacted with the wafer was moved to the wafer side or moved away from the wafer.

Figure 2:
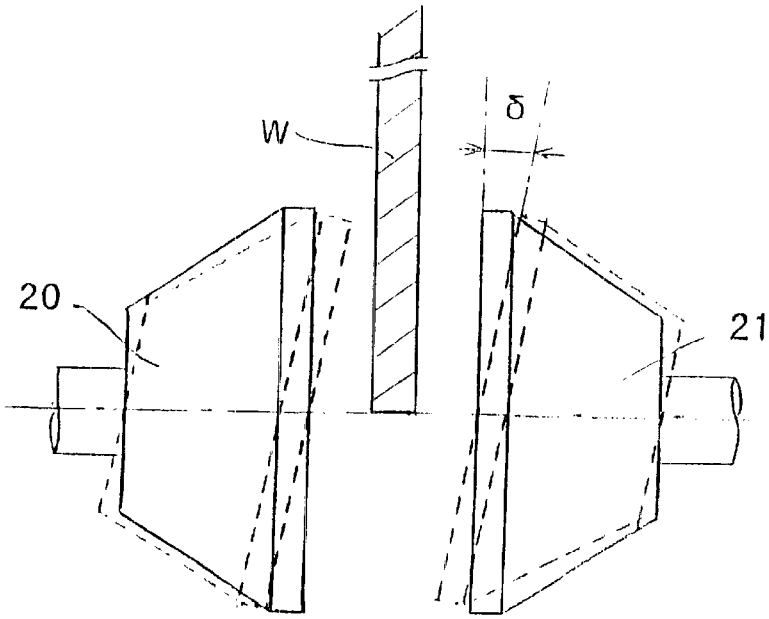
FIG. 2 shows an explanatory view of action when a double head grinding stone shaft is tilted.

FIG. 2 shows grinding stones (one grinding stone 20 (left) and the other grinding stone 21 (right)) tilted with respect to a wafer W by the tilt amount, $\delta$, (μm), of a right-and-left grinding stone shaft.

Figure 4:
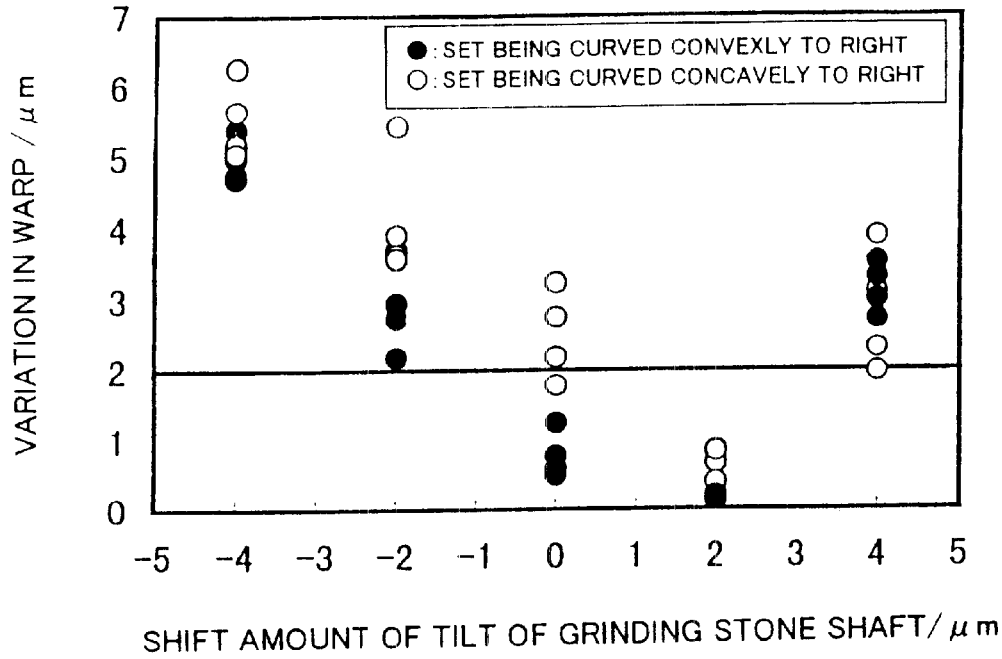
FIG. 4 shows a graph representing a relation between the shift amount of tilt of the double head grinding stone shaft and the variation in warp.

The measurement results are shown in FIG. 4. In FIG. 4, the abscissa axis represents the shift amount of the tilted grinding stones, and the ordinate axis represents the variation in the warp, i.e., |"warp after grinding"−"warp before grinding"|.

This figure shows that, when the shaft is tilted 2 μm to the right, the variation in the warp can be minimized.

This is because the surfaces of the right-and left grinding stones come to be parallel to the wafer by virtue of adjusting the tilt of the right-and-left grinding stone shaft, resulting in decrease of influence of warpage formed in the grinding. Accordingly, in order to perform grinding without causing warpage, such compensation of tilt of the grinding stone shaft is required.

Test for relative position of wafer to grinding stones

The optimum relative position of a wafer to grinding stones in case of using a double head grinding machine having the arrangement as shown in FIG. 1 was researched.

A wafer was fixed at a predetermined position and one grinding stone (left side) was regarded as a reference side grinding stone. The reference side grinding stone was shifted from its reference position to right side by 0, 5, 10, 15, 20, 25, or 30 μm, and thereby the wafer supporting position and the relative position of the reference side grinding stone were varied. After shifting of such position, the relative position between the reference side grinding stone and wafer supporting portions on the side of this grinding stone was fixed, the grinding stone and the like on the opposite side were moved corresponding to the proper grinding stock removal, and then the grinding was performed. After that, warpage of the wafer was measured.

The first position of the reference side grinding stone (reference position=0) did not necessarily coincide with the center of the wafer, but was determined arbitrarily. Further, warpage of the material wafer was about 10 μm.

Figure 3:
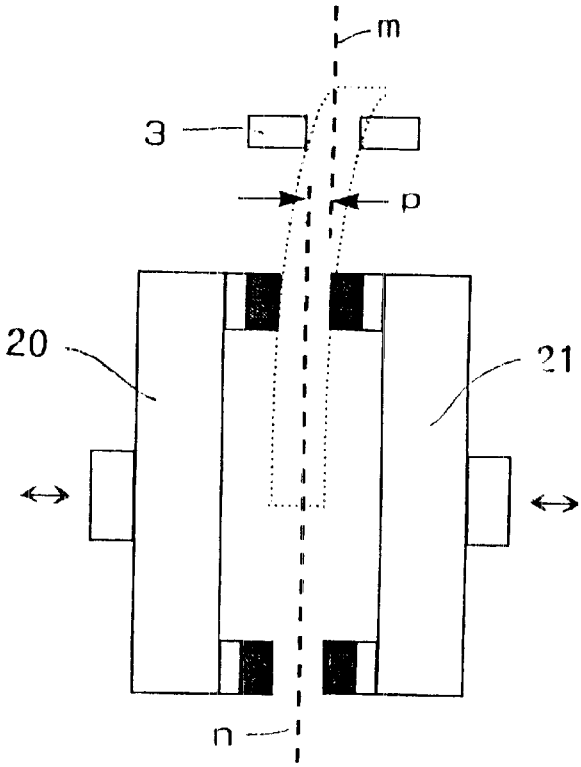
FIG. 3 shows an explanatory view of action when there is a discrepancy between the center of a plate-like workpiece holding means and the center between grinding stone surfaces according to the present invention.

FIG. 3 represents warpage of a wafer (dotted line) formed when there is a discrepancy (difference) p between the center m of a pair of plate-like workpiece driving-holding rollers 3 fixed at a predetermined position (the center of thickness of the wafer), and the center n of space between surfaces of right-and-left grinding stones.

Figure 5:
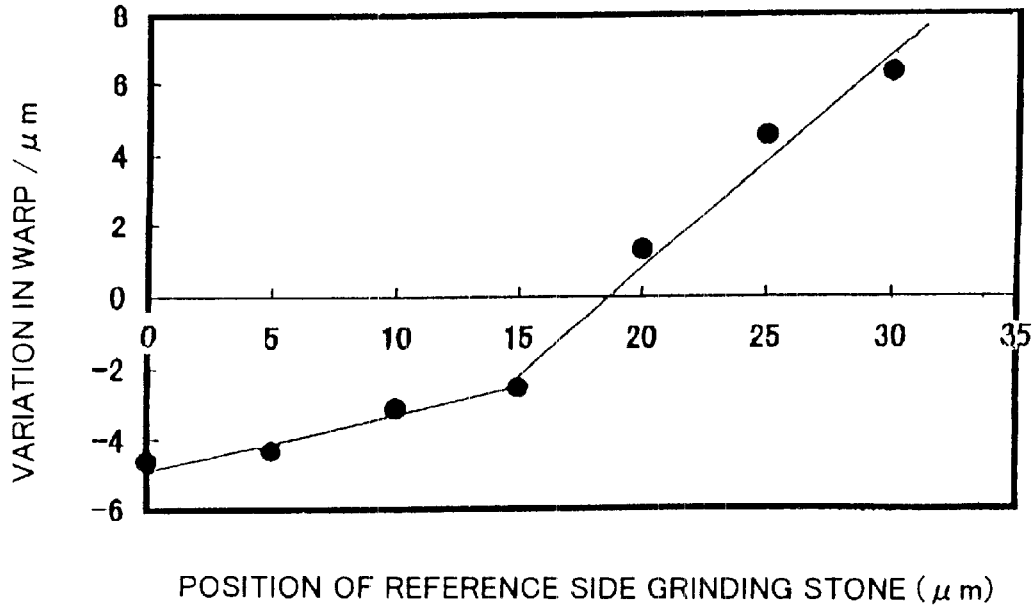
FIG. 5 shows a graph representing a relation between the position of a reference grinding stone and the variation in warp according to the present invention.
Figure 6:
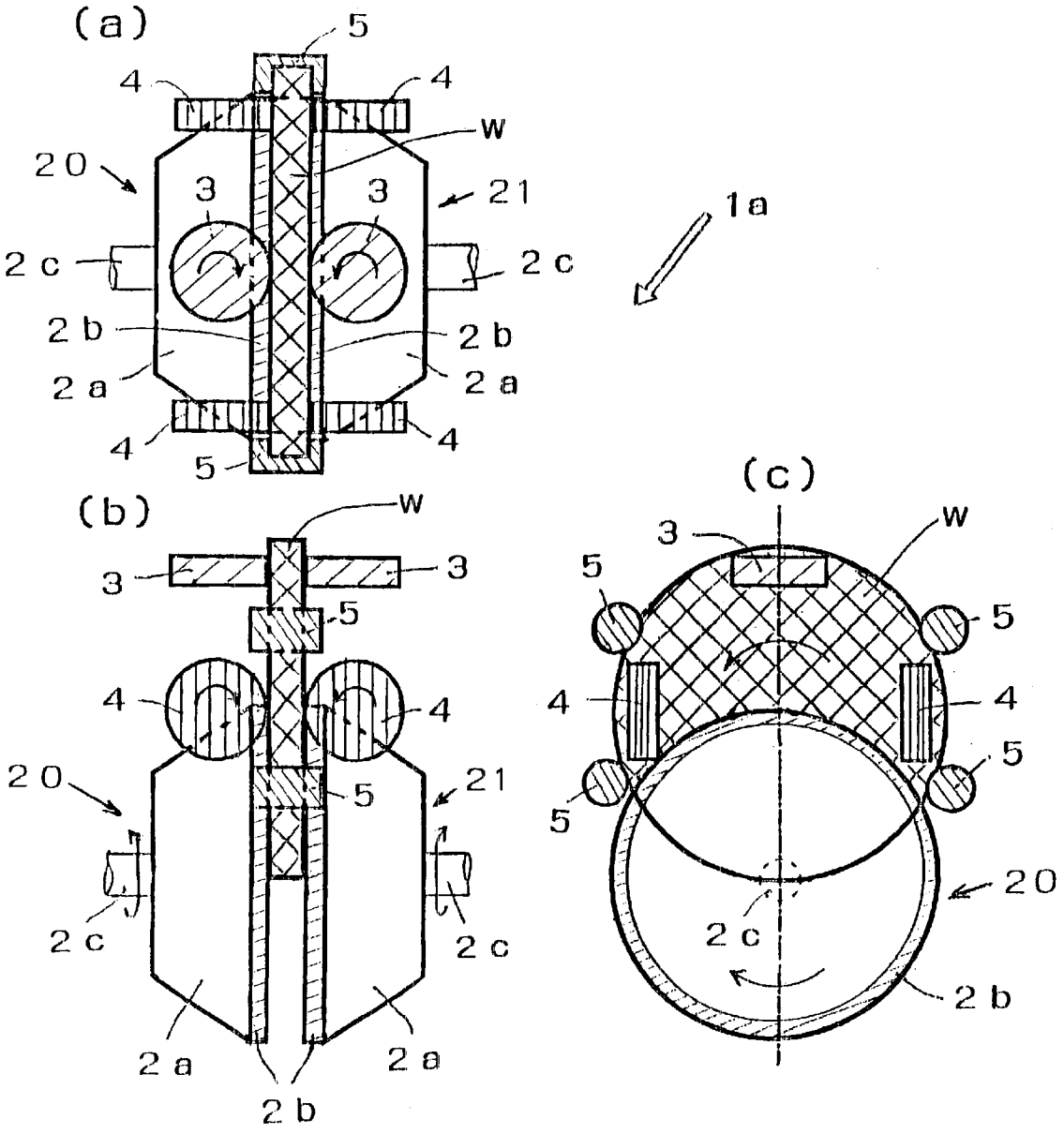
FIG. 6 PRIOR ART
FIG. 6 shows schematic explanatory views of an exemplary conventional double side simultaneous grinding machine: (a) plan view, (b) front view, and (c) side view.

The results are shown in FIG. 5. In FIG. 5, the abscissa axis represents the distance to which the grinding stone is shifted, and the ordinate axis represents the variation in the warp, i.e., |"warp after grinding"−"warp before grinding"|.

This figure shows that when the relative position of the wafer to the grinding stone is varied, there exists the position of the reference side grinding stone wherein the variation in the warpage is minimized (the variation in warp=0). And it also shows that when the reference side grinding stone is shifted from the optimum position, the wafer is deformed as shown in FIG. 3 and the degree of the warpage varies.

In this example, at the position wherein the reference side grinding stone is shifted from the reference position determined arbitrarily to right side by about 15–20 μm, the amount of change in warp is minimized, and therefore it is revealed that this position is the most preferable one for the relative position between the wafer and the grinding stones. This optimum position is the position-wherein the center of the wafer (the center of the wafer holding means) and the center of the grinding stones (the midpoint between right-and-left grinding surfaces) approximately coincide.

A conventional double side simultaneous grinding machine has been provided with an adjusting device of grinding stone shaft tilt for adjusting parallelism between the wafer and the right-and-left grinding stones, however, neither means for detecting a position of the center of thickness of the wafer (wafer holding means) and a position of the center between the surfaces of grinding stones, nor a device for adjusting the relative position thereof is provided. Accordingly, in order to find the optimum position in the conventional double side simultaneous grinding apparatus, the aforementioned tests must be performed and compensation of the position of the grinding stones or the wafer is required.

If the optimum position of the wafer and the grinding stones is always monitored and controlling means is provided so as not to shift the relative position, like in embodiments of the present invention, the aforementioned tests do not need to be performed. Furthermore, once the reference position is determined correctly and a detector of center of the plate-like workpiece holding means 9 and a detector of center between grinding stone surfaces 10 are calibrated, in the subsequent grinding, the workpiece can be ground stably without degradation of warpage.

Furthermore, FIG. 5 shows that when the reference side grinding stone is shifted from the reference position, the warpage of the wafer varies approximately in proportion to its shifting amount.

In the graph of FIG. 5, the warpage is degraded on the right of the optimum value (about 19 μm) of the position of the reference side grinding stone. That is, the warpage of the material wafer which was 10 μm is degraded to 16 μm.

On the other hand, it is revealed that the warpage is improved on the left of the optimum value and the warpage of the wafer after grinding is improved to about 5 μm.

Such a result was obtained for the following reason. The material wafer was set to be curved convexly to the right (about 10 μm), and thus the wafer was ground so as to warp adversely. That is, it is revealed that by virtue of shifting from the optimum position to right or left side (varying the relative position between the wafer and the grinding surfaces), both the direction and the degree of warpage can be controlled arbitrarily.

From the two kinds of tests described above, it is revealed that, if the position of the wafer relative to the grinding stones and the tilt of the grinding stone shaft are optimized, the generation of warpage can be prevented and the degradation of warpage can be suppressed.

Moreover, if the amount and direction of the shifting are controlled to be desired values, the wafer having a warpage of desired degree and direction can be produced.

That is, in the double side simultaneous grinding, when a wafer is not loaded or equally loaded on both sides with two grinding stones (both sides of the wafer are under the same grinding condition), the coincidence of the center of thickness of the wafer and the center between the surfaces of grinding stones is a necessary condition for preventing the generation of warpage and suppressing the degradation of warpage.

Accordingly, it is important to dispose the plate-like workpiece and the pair of grinding stones such that they are parallel to each other, and to set a condition before grinding such that at least one of the center of thickness of the plate-like workpiece and the center of holding means for holding the workpiece, and the center between the stone surfaces of the pair of grinding stones always coincide. Preferably, the grinding may be performed while the difference (discrepancy) between both centers is controlled so as to be 3 μm or less. By virtue of such condition, grinding without warpage can be achieved.

In order to more certainly achieve the aforementioned object and suppress warpage, in actual grinding, it is important to suppress to the utmost the variation of feed rate and rotational speed of grinding stones and the deflection of the grinding stone rotating shafts, to suppress the deflection of the grinding surfaces in rotating of the grinding stones, thereby maintaining flatness.

Further, the following fact needs to be considered. Because the plate-like workpiece is not a completely rigid body, the workpiece may deform to some degree, or be pressed and bruised with the grinding stones. Thereby, the difference of grinding condition between each side is moderated, so that the variation of grinding stock removal is likely to occur.

Further, when the grinding force becomes large due to loading of grinding stones during grinding and the like, the force with which the grinding stones press the wafer (processing force) becomes large, which may cause deformation of the wafer in grinding. However, dressing of the grinding stones makes the grinding force smaller, and thereby the deformation of the wafer can be suppressed and the warpage can be improved.

In the double side simultaneous grinding machine, positioning of grinding stones is usually conducted according to a decrease in thickness of the wafer due to grinding. However, it was revealed that the warpage could not be controlled solely by positioning according to the decrease in thickness because of the variation of grinding conditions (abrasion wear of grinding stone or grinding stock removal), the deformation of the wafer, or the like, so that a discrepancy in the relative position between the wafer and the grinding stones was caused.

Therefore, the double side simultaneous grinding machine of the present invention is provided with a means for detecting, compensating and controlling such a discrepancy, with which the conventional double side simultaneous grinding machine has not been provided. Thereby, this discrepancy is automatically compensated and controlled before grinding and during grinding. Thus, the present invention is provided with a means for controlling the relative position which has a means for detecting the position of the holding means for holding the plate-like workpiece and a means for detecting the positions of each surface of the grinding stones.

The controlling method may be performed by detecting positions of the wafer (wafer holding means) and each surface of the grinding stones all the time, processing the detected positions by a computer, and changing the position of the wafer (wafer holding means) and/or the position of grinding stones based on the detected positions processed by the computer.

If the grinding is performed while the difference (discrepancy) between at least one of the center of thickness of the plate-like workpiece and the center of holding means for holding the workpiece, and the center between the stone surfaces of the pair of grinding stones is controlled so as to be a desired value, the control of the relative position enables the formation of a warpage having an arbitrary degree and the control of the direction of warpage.

In addition, the double side simultaneous grinding can control the direction of warpage, because the grinding stones set up as shown in FIG. 1 can be shifted both to right side and to left side of the position of the wafer, which is different from single side grinding. Thus, if the advance examination in direction and degree of warpage of a material wafer is performed, a value of the warp can be decreased by controlling the warpage to have the opposite direction to the original direction.

Further, the warpage may be provided to the wafer intentionally. Then, by virtue of a subsequent single side thin film formation, the generated warpage may be eliminated.

The plate-like workpiece holding means in the double side simultaneous grinding machine has various types.

For example, the holding means shown in FIG. 1 is composed of plural holding means such as two pairs of plate-like workpiece press rollers 4 for supporting a plate-like workpiece W on its both sides, four plate-like workpiece guide rollers 5 for supporting a circumference of the plate-like workpiece W, a pair of plate-like workpiece driving-holding rollers 3 for rotating the plate-like workpiece in opposite direction to the grinding stones and holding the workpiece, and so forth.

Meanwhile, another method exists wherein the workpiece is held by the pressure of coolant which is injected to the both sides of the workpiece with equal pressure from plural hydrostatic pads, and supported by plural plate-like workpiece guide rollers and a pair of plate-like workpiece driving-holding rollers for supporting the circumference of the plate-like workpiece.

When the holding means comprises plural components as described above, it is preferable to make the center of all holding means and the center between the surfaces of the pair of grinding stones coincide. However, even though all centers do not coincide, if the center of a holding means which defines the position of the plate-like workpiece most effectively of all holding means and the center between the grinding stone surfaces coincide, the machine can make the effect.

The control of the relative position of both centers may be conducted by the plate-like workpiece holding means, or conducted such that the plate-like workpiece is fixed at a predetermined position and the pair of grinding stones is shifted simultaneously or respectively.

In addition to the positioning according to a decrease in thickness of the plate-like workpiece, this control of the relative position between the center of the plate-like workpiece holding means and the center between the surfaces of the pair of grinding stones enables compensation of the discrepancy between the center of the holding means and the center between the grinding stone surfaces which is caused by the grinding pressure, the life of the grinding stones, or the like.

As a means for detecting a position of the plate-like workpiece (plate-like workpiece holding means) and positions of each grinding stone surfaces, one may utilize a variation of a reflection position of laser beam, or a detector for detecting the positions directly with various sensors such as an air micrometer or an electric micrometer may be used. A detector for indirectly detecting the mechanical positions of portions which place and hold the plate-like workpiece and the grinding stones may also be used. However, the detector for indirectly detecting the positions needs compensation in consideration of the grinding stock removal of the plate-like workpiece, the abrasion wear of the grinding stones, etc.

In order to adjust parallelism between a plate-like workpiece and grinding surfaces of two grinding stones, the machine may be provided with a grinding stone shaft angle controlling means for adjusting tilt of grinding stone shaft, so that the tilt angle can be adjusted in advance before grinding by a stepping motor, etc. The machine may also be equipped with a grinding stone shaft angle detector for detecting the tilt angle of the grinding stone shaft. Results of its detection are processed by a computer and then inputted to the above controlling means of tilt angle of grinding stone shaft, so that the control of tilt angle of the grinding stone shaft can be automated.

Hereafter, the present invention will be explained in detail with reference to examples of the present invention and comparative examples. However, the present invention is not limited to these.

EXAMPLE 1

A pair of cup-type grinding stones of vitrified bond #2000 (width of grinding stone portion about 3 mm) having a diameter of 200 mm was mounted on a double side simultaneous grinding machine shown in FIG. 1, and then a semiconductor silicon wafer was ground.

The silicon wafer having a thickness of 775 $\mu$m and a diameter of 200 mm (8 inches), which had been sliced from ingot with a wire saw, was used.

A basic grinding condition was as follows: workpiece rotation number: 7–25 rpm, grinding stone rotation number: 2000–3500 rpm, grinding stone feed rate: 60–300 $\mu$m/min, flow rate of grinding water: 3–15 L/min, grinding stock removal: 60 $\mu$m as total removal of both surfaces, and so forth.

After the center of the holding means for holding the workpiece and the center between the grinding stone surfaces were made to coincide manually on initial setting before grinding the workpiece was simultaneously ground for the both sides under the same condition.

As a result, while the warp value before grinding was 5–25 $\mu$m, the warpage after grinding hardly changed as compared with that before grinding. The warpage was measured through use of an ADE UG9700 (produced by ADE Co.).

After grinding, it was confirmed that the difference between the center of the wafer holding means and the center between the grinding stone surfaces had been controlled to be 3 $\mu$m or less.

Comparative Example 1

The grinding was performed under the same conditions as in the Example 1 except that plural wafers were ground repeatedly without compensating a discrepancy between the center of the wafer holding means and the center between the grinding stone surfaces.

As a result, while the warp value before grinding was 5–25 $\mu$m, the generation of warpage after grinding gradually increased, and further there was variation in the manner of generation. It was seen that the warpage changed approximately 10 $\mu$m on average.

After grinding, it was observed that here was the discrepancy of 10 $\mu$m or more between the center of the wafer holding means and the center between the grinding stone surfaces.

EXAMPLE 2

A pair of turn tables made of casting iron and having a diameter of 200 mm was mounted on double side simultaneous lapping machine shown in FIG. 7, and then a semiconductor silicon wafer was lapped. As a lapping turn table, ring-shaped casting iron having a width of 50 mm which had been grooved was used.

The silicon wafer having a thickness of 775 $\mu$m and a diameter of 200 mm (8 inches), which had been sliced from ingot with a wire saw, was used.

A basic lapping condition was as follows: workpiece rotation number: 10 rpm, turn table rotation number: 500 rpm, lapping load: 100–300 gf/cm$^2$, lapping fluid: slurry containing alumina abrasives #1200, flow rate of slurry: 150 ml/min, and lapping removal: 60 $\mu$m as total removal of both surfaces.

After the center of the holding means for holding the workpiece and the center between the surfaces of the lapping turn tables were made to coincide manually on initial setting before lapping, the workpiece was simultaneously lapped for the both sides under the same condition.

As a result, while the warp value before lapping was 5–25 $\mu$m, the warpage after lapping hardly changed as compared with that before lapping. After lapping, it was confirmed that the difference between the center of the wafer holding means and the center between the lapping turn table surfaces had been controlled to be 3 $\mu$m or less.

Comparative Example 2

The lapping was performed under the same conditions as in Example 2 except that plural wafers were lapped repeatedly without compensating a discrepancy between the center of the wafer holding means and the center between the lapping turn table surfaces.

As a result, while the warp value before lapping was 5–25 $\mu$m, the generation of warpage after lapping gradually increased, and further there was variation in the manner of generation. It was seen that the warpage changed approximately 10 $\mu$m on average.

After lapping, it was observed that there was the discrepancy of 10 $\mu$m or more between the center of the wafer holding means and the center between the lapping turn table surfaces.

Further, the present invention is not limited to the embodiments described above. The above-described embodiments are mere examples, and those having the substantially same structure as that described in the appended claims and providing the similar functions and advantages are included in the scope of the present invention.

For example, although a type of double side simultaneous grinding machine [double side simultaneous lapping machine] exists for holding the plate-like workpiece vertically and a type exists for holding the plate-like workpiece horizontally, the present invention is not limited to either type and can be applied to any other types.

While wafers sliced from a silicon single crystal ingot having a diameter of 200 mm (8 inches) are ground [lapped] in the embodiments of the present-invention, the present invention can sufficiently be applied to recently used wafers having a diameter of 250 mm (10 inches) to 400 mm (16 inches) or larger.

What is claimed is:

1. A method for simultaneously grinding both a front surface and a back surface of a plate-like workpiece, the method comprising:

supporting both the surfaces of the workpiece by a workpiece holding means;

bringing a pair of grinding stones opposed at both sides of the workpiece into contact with the workpiece to perform simultaneous grinding of both surfaces of the workpiece; and controlling a relative position of a center between stone surfaces of the pair of grinding stones and at least one of a center of thickness of the workpiece and a center of the holding means while performing the simultaneous grinding.

2. The method of claim 1, wherein the controlling is such that at least one of the center of thickness of the workpiece and the center of the holding means is always consistent with the center between stone surfaces of the pair of grinding stones while performing the simultaneous grinding.

3. The method of claim 1, wherein the controlling is such that a difference between the center between stone surfaces of the pair of grinding stones and at least one of the center of thickness of the workpiece and the center of the holding means is 3 $\mu$m or less while performing the simultaneous grinding.

4. The method of claim 2, wherein the controlling is such that a difference between the center between stone surfaces of the pair of grinding stones and at least one of the center of thickness of the workpiece and the center of the holding means is 3 $\mu$m or less while performing the simultaneous grinding.

5. The method of claim 7, wherein the controlling is such that a difference between the center between stone surfaces of the pair of grinding stones and at least one of the center of thickness of the workpiece and the center of the holding means is a desired value while performing the simultaneous grinding.

6. A grinding machine, comprising:

a holding means for holding a plate-like workpiece having a front surface and a back surface;

a grinding means for simultaneously grinding both the front surface and the back surface using a pair of grinding stones provided opposite to each other on respective sides of the workpiece; and a controlling means for controlling a relative position of a center between stone surfaces of the pair of grinding stones and at least one of a center of thickness of the workpiece and a center of the holding means while performing the simultaneous grinding.

7. The grinding machine of claim 6, wherein the controlling means comprises:

a means for detecting a position of the holding means for holding the plate-like workpiece;

a means for detecting a position of each grinding stone surface;

a computer for processing the detected positions; and a means for changing at least one of the position of the holding means and the position of the grinding stones based on the detected positions processed by the computer.

8. The grinding machine of claim 6, wherein the controlling means controls the relative position so as to be constant at a predetermined value.

9. The grinding machine of claim 8, wherein the predetermined value is 3 $\mu$m or less.

10. The grinding machine of claim 7, wherein the controlling means controls the relative position so as to be constant at a predetermined value.

11. The grinding machine of claim 10, wherein the predetermined value is 3 $\mu$m or less.

12. A method for simultaneously lapping both a front surface and a back surface of a plate-like workpiece, the method comprising:

supporting both the surfaces of the workpiece by a workpiece holding means;

bringing turn table surfaces of a pair lapping turn tables into contact with the workpiece to perform simultaneous lapping of both surfaces of the workpiece, the pair of lapping turn tables being provided opposite to each other on respective sides of the workpiece; and controlling a relative position of a center between turn table surfaces of the pair of lapping turn tables and at least one of a center of thickness of the plate-like workpiece and a center of the holding means while performing the lapping.

13. The method of claim 12, wherein the controlling is such that at least one of the center of thickness of the plate-like workpiece and the center of the holding means is always consistent with the center between turn table surfaces of the pair of lapping turn tables while performing the lapping.

14. The method of claim 12, wherein the controlling is such that a difference between the center between turn table surfaces of the pair of lapping turn tables and at least one of the center of thickness of the plate-like workpiece and the center of the holding means is 3 $\mu$m or less while performing the lapping.

15. The method of claim 13, wherein the controlling is such that a difference between the center between turn table surfaces of the pair of lapping turn tables and at least one of the center of thickness of the plate-like workpiece and the center of the holding means is 3 $\mu$m or less while performing the lapping.

16. The method of claim 12, wherein the controlling is such that a difference between the center between turn table surfaces of the pair of lapping turn tables and at least one of the center of thickness of the plate-like workpiece and the center of the holding means is a desired value while performing the lapping.

17. A lapping machine, comprising:

a holding means for holding a plate-like workpiece having a front surface and a back surface;

a lapping means for simultaneously lapping both the front surface and the back surface using a pair of lapping turn tables provided opposite to each other on respective sides of the workpiece; and a controlling means for controlling a relative position of a center between turn table surfaces of the pair of lapping turn tables and at least one of a center of thickness of the workpiece and a center of the holding means while performing the lapping.

18. The lapping machine of claim 17, wherein the controlling means comprises:

a means for detecting a position of the holding means for holding the plate-like workpiece;

a means for detecting a position of each lapping turn table surface;

a computer for processing the detected positions; and a means for changing at least one of the position of the holding means and the position of the lapping turn tables based on the detected positions processed by the computer.

19. The lapping machine of claim 17, wherein the controlling means controls the relative position so as to be constant at a predetermined value.

20. The lapping machine of claim 19, wherein the predetermined value is 3 $\mu$m or less.

21. The lapping machine of claim 18, wherein the controlling means controls the relative position so as to be constant at a predetermined value.

22. The lapping machine of claim 21, wherein the predetermined value is 3 $\mu$m or less.

* * * * *